US007884556B2

(12) United States Patent
Gandhi

(10) Patent No.: US 7,884,556 B2
(45) Date of Patent: Feb. 8, 2011

(54) COLOR-CHANGING LIGHT ARRAY DEVICE

(75) Inventor: Samir Gandhi, Simi Valey, CA (US)

(73) Assignee: Advanced Color Lighting, Inc., Simi Valley, CA (US)

( * ) Notice: Subject to any disclaimer, the term of this patent is extended or adjusted under 35 U.S.C. 154(b) by 66 days.

(21) Appl. No.: 12/357,146

(22) Filed: Jan. 21, 2009

(65) Prior Publication Data

US 2009/0121651 A1 May 14, 2009

Related U.S. Application Data

(63) Continuation-in-part of application No. 11/228,062, filed on Sep. 16, 2005, now Pat. No. 7,489,089.

(51) Int. Cl.
*H05B 37/02* (2006.01)

(52) U.S. Cl. ..... 315/291; 315/294; 315/302

(58) Field of Classification Search ..... 315/129, 315/130, 132, 291, 307, 294, 312, 299, 300, 315/302

See application file for complete search history.

(56) References Cited

U.S. PATENT DOCUMENTS 4,317,071 A 2/1982 Murad
5,420,482 A 5/1995 Phares
6,016,038 A 1/2000 Mueller et al.
6,150,774 A 11/2000 Mueller et al.
6,211,626 B1 4/2001 Lys et al.
6,292,901 B1 * 9/2001 Lys et al. ..... 713/300
6,340,868 B1 1/2002 Lys et al.
6,348,766 B1 2/2002 Ohishi et al.
6,528,954 B1 3/2003 Lys et al.
6,801,003 B2 10/2004 Schanberger et al.
6,806,659 B1 10/2004 Mueller et al.
7,038,399 B2 5/2006 Lys et al.
7,106,378 B2 9/2006 Kawakami
7,180,252 B2 2/2007 Lys et al.
7,186,000 B2 3/2007 Lebens et al.
2002/0047628 A1 4/2002 Morgan et al.
2002/0071279 A1 * 6/2002 Katogi et al. ..... 362/317
2003/0206411 A9 * 11/2003 Dowling et al. ..... 362/234
2004/0207334 A1 10/2004 Lin
2005/0174473 A1 8/2005 Morgan et al.

* cited by examiner

*Primary Examiner*—Jacob Y Choi
*Assistant Examiner*—Ephrem Alemu
(74) *Attorney, Agent, or Firm*—Michael Blaine Brooks, P.C.; Michael B. Brooks

(57) ABSTRACT

A color-changing light array powered by a driver circuit, the driver circuit responsive to a controller circuit, and the controller circuit configured to change display lighting patterns or colors based on modes of operation and off-on power cycle intervals.

12 Claims, 7 Drawing Sheets

COLOR-CHANGING LIGHT ARRAY DEVICE

CROSS-REFERENCE TO RELATED APPLICATION

This application is a continuation-in-part of application Ser. No. 11/228,062 filed Sep. 16, 2005, now U.S. Pat. No. 7,489,089 which is hereby incorporated herein by reference in its entirety for all purposes.

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

1. Technical Field of Endeavor

The invention, in its several embodiments, generally relates to lighting systems based on Light Emitting Diodes (LEDs), and more specifically to a method and apparatus of controlling intensity and perceived color temperature of one or more LED clusters or triplets in order to provide a display of different colors as perceived by a person, and still more precisely, to effect various colors and display patterns from an array of LEDs based on time sensitive on-off switching.

2. State of the Art

LEDs may be employed to produce a lighting system with a varying color scheme, which is often desired for applications such as lamps, back light sources, traffic signals, display boards, illuminating switches and commercial lighting. LEDs are available in basic colors that comprise red, green and blue (RGB), and other colors can be generated for human perception by manipulating the intensity of individual LEDs of a cluster of at least three LEDs comprising each of red, green and blue.

U.S. Patent Publication Number US 2004/0207334 by Lin discloses a system for a color-changing bulb for the instrument panel of a vehicle, which is made as a bulb and directly installable in a bulb seat of the instrument panel. The color-changing bulb includes a bulb housing defining a receiving space for receiving a light emitting diode and a circuit board. The LED includes three LED chips for generating red, blue and green light components. A controlling circuit is disposed on the circuit board and connected with the LED for driving the three-color LED chips to emit light. By use of a brightness adjustment switch on the instrument panel or a headlight switch, at least seven combinations of colors of light can variably emitted. The Lin publication also discloses a memory unit to store or count the number of times the headlight switch is switched to create additional signals indicating which color the LED system should effectively produce in the sense of human perception. This system is disclosed as having a stabilizing unit and a digital cycle outputting unit.

U.S. Patent Publication Number US 2002/0047628 by Morgan et al., discloses a system applicable for outdoor decorating retail, commercial and residential places.

U.S. Pat. No. 5,420,482 to Phares, discloses a color display apparatus in which each of the three-color LED unit in a circuit are driven by transistor biasing. In this system, each transistor base is coupled to a respective latch resistor. Also, the biasing of the transistor according to Phares may be changed by changing the grounding resistor of the potential divider.

U.S. Pat. No. 6,016,038 to Mueller, et al., discloses a pulse width modulated current control for an LED lighting assembly, where each current-controlled unit is uniquely addressable and capable of receiving illumination color information on a computer lighting network. The light module of Mueller may be interchanged with other light modules having programmable current and maximum light intensity ratings. Muller, et al., teaches the use of a computer controller to operate the pulse width modulated LED lighting assembly.

U.S. Pat. No. 6,150,774, also to Mueller, et al., discloses a pulse width modulated current control for an LED lighting assembly wherein each current-controlled unit is uniquely addressable and capable of receiving illumination color information on a computer lighting network. The use of a manual control for an LED lighting assembly is disclosed.

U.S. Pat. No. 6,211,626 to Lys, et al. discloses a light module having an LED system for generating a range of colors within a color spectrum, a processor for controlling the amount of electrical current supplied to the plurality of light emitting diodes, so that a particular amount of current supplied thereto generates a corresponding color within the color spectrum, and a housing within which the LED system is positioned.

U.S. Pat. No. 6,340,868 to Lys, et al. discloses a computer controlled multicolored lighting network comprising a light module having a plurality of light emitting diodes for generating light for a range of colors within a color spectrum, a processor for controlling the amount of electrical current supplied to each light emitting diode such that a particular amount of current supplied to the light module generates a corresponding color within the color spectrum, and a power module for providing electrical current from a power source to the light module, where the power module includes a connector for removably and replaceably connecting the power module to the light module.

U.S. Pat. No. 6,528,954 to Lys, et al. also relates to LED lighting assemblies, and discloses the use of a processor to control current through the LEDs.

Decorative lighting via a controlled lighting system is disclosed in U.S. Pat. No. 4,317,071 to Murad in which three circuits are disclosed as directly connected to one or more lighting element of a particular color.

SUMMARY

The present invention includes system and method embodiments for color-changing lighting comprising a preprogrammed controller along with driver circuit, a single or combination of LEDs and an OFF/ON switch which is used for making a selection of mode of operation as well as switching the system ON/OFF. Brightness is changed using pulse width modulation. The LEDs may be selectively activated by a programmed variable pulse to generate desired color mixing effect. The resulting illumination may be controlled by a computer/micro-controller program to provide pre-designed complex patterns of light in various environments. Accordingly, an exemplary device embodiment of the present invention may comprise: a color-changing light array powered by a driver circuit, the driver circuit responsive to a controller circuit and the controller circuit responsive to a user interface, wherein the controller circuit is configured to: (a) set an initial mode of color-changing light array operation to a first mode of color-changing light array operation based on a powering of the color-changing light array; (b) set the mode of color-changing light array operation to a subsequent mode of color-changing light array operation based on powering off and then powering the color-changing light array within a first predetermined time interval; and (c) set a submode of color-changing light operation to a submode of color-changing light operation, after the expiration of the first predetermined time interval. In some device embodiments, the exemplary controller circuit may be further configured to reset the mode of color-changing light array operation to the first mode of color-changing light array operation based on powering off and then, within a third predetermined time interval, powering the color-changing light array. The modes of color-changing light array operation of the devise may include at least: (a) continually cycling displays from the set of light patterns or colors, e.g. cycling to another pattern every 15 seconds; and (b) selectable displays of static light patterns or colors. The selectable displays of static light patterns or colors may be embodied as displays of rotating or cycling set of selectable patterns and/or colors. The submode of the mode of the continually cycling display from the set of light patterns or colors may include starting the continually cycling display from the predetermined light pattern or color. The submode of the mode of the selectable displays of static light patterns or colors may include a static light pattern or color based on the last selectable display of light patterns or colors, displayed prior to the color-changing light array power off-on cycle of a second predetermined time.

Other embodiments of the device may comprise a color-changing light array powered by a driver circuit, the driver circuit responsive to a controller circuit and the controller circuit responsive to a user interface, wherein the controller circuit is configured to: (a) start with an initial mode of operation upon the powering on of the color-changing light array; (b) provide visual display of a mode of operation via the color-changing light array; (c) change the initial mode of operation to a selected mode of operation responsive to a power off-on cycle of the color-changing light array within a range of a first predetermined time interval, e.g., a ten-second interval; (d) if the selected mode of operation produces a continually cycling display of light patterns or colors, preserve the selected mode of operation, and start the continually cycling display from a predetermined light pattern or color; and (f) if the selected mode of operation produces selectable displays of static light patterns or colors, preserve, responsive to a color-changing light array power off-on cycle having at least the range of the second predetermined time interval, e.g., a five-second interval, the selected mode of operation having the last selectable display of light patterns or colors, displayed at a start of the color-changing light array power off-on cycle of the second predetermined time interval, a static light pattern or color. Some embodiments of the device may be further configured where, if the selected mode of operation produces the continually cycling display from the set of light patterns or colors, wherein the controller circuit is configured to preserve the selected mode, responsive to a color-changing light array power off-on cycle having at least the range of the second predetermined time interval, and restart the continually cycling display from the predetermined displayed light pattern or color. Some embodiments of the device may be further configured to reset the modes of operation based on a powering of the color-changing light array off and on within a third predetermined time interval, e.g., a three-second, four-second, or five-second time interval, while the color-changing lighting system is in any selected mode of operation; and restart with the initial mode of operation.

BRIEF DESCRIPTION OF THE DRAWINGS

Embodiments of the present invention are illustrated by way of example and not limitation in the figures of the accompanying drawings, and in which.

DETAILED DESCRIPTION

Figure 1:
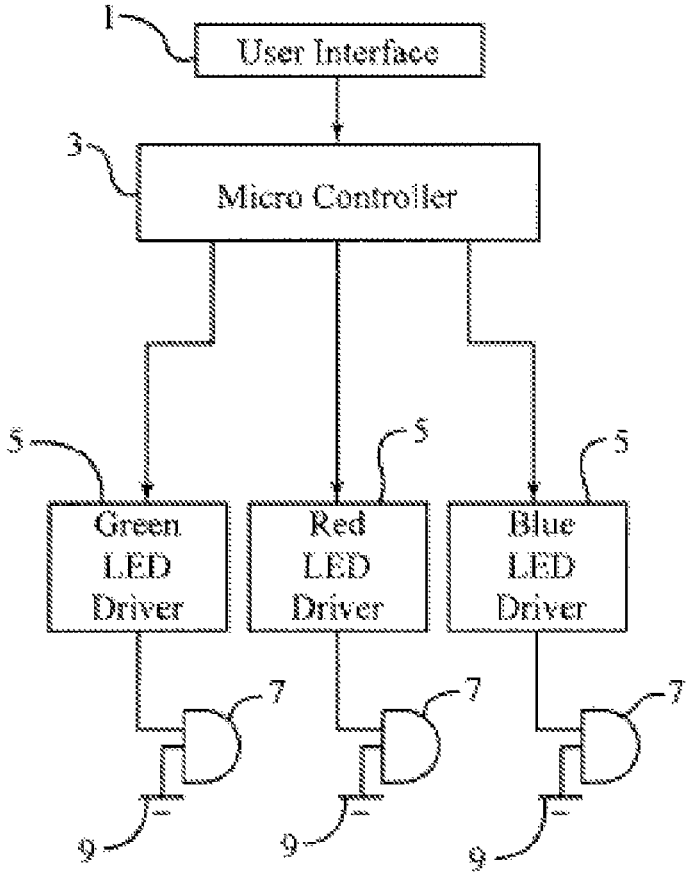
FIG. 1 shows a functional block diagram of an embodiment of the present invention.

Embodiments of the present invention include a system and method for color-changing lighting, having a pre-programmed controller with driver circuit, single or combination of LEDs and an OFF/ON switch which is used for making a mode of operation selection as well as switching the system on and off. The brightness of the LED or combination of LEDs is changed using pulse width modulation. Embodiments of the invention provide a user choices of flashing or steady state color selection of lighting of LEDs.

This system is capable of working on a regulated or unregulated power supply and the driver circuit of the system is provided with an external resistor to set the drive current for different LED arrays and it keeps equal current in each leg of LEDs in varying forward voltage with the help of transistors. The LEDs may be selectively activated by programmed variable pulses to generate the desired color mixing effect. The controller controls the lighting mode and color of the LEDs, and may be implemented using eight bits of data in the exemplary embodiment to provide a maximum of 256 intensity levels per LED, and thereby generating a human-perceived smooth transition from one color to another.

The controller uses an external crystal which allows all light modules in the system to be synchronized, and is capable of storing the mode and color (or combination of colors) at the time it is switched off. In an alternate embodiment, an internal oscillator may be used for synchronization. The system provides options for selecting one mode of two different modes of operation; namely rotating color mode and fixed color mode.

When the system is initially powered on, a user may select from a variety of color modes. A user can switch from mode to mode by turning the power off and on within a first predetermined time, called the "switching time." In an exemplary embodiment and for purposes of illustration, a period of five seconds or less is used. All mode switching operations must be completed within a second predetermined time, called the "synchronize time." For purposes of illustration, a period of ten seconds is used. Accordingly, each time the power is turned off and on in under five seconds, from the first time the power is turned on until the end of the synchronize time at ten seconds, the light control starts in a new mode of operation. To select a mode, a user simply leaves the system on until the end of the synchronize time.

Each mode is characterized by either a changing, selectable or static light pattern of one or a variety of colors, and each mode has a corresponding indicator pattern that is displayed by the LEDs of the system during the synchronize time. When the synchronize time ends, the LEDs transition from displaying the indicator pattern to either a color-changing cycle or static color of the mode selected.

For instance, in a system with standard red green and blue LEDs, when the power is initially switched on, a green LED may blink to indicate a first (default) mode. If the power is turned off for less than five seconds and back on again, a red blinking LED may be used to indicate that the system has switched to a second mode. If the power is then turned off a third time and back on within five seconds, the system goes into a third mode that may be reflected by a blue LED indicator.

If the mode is switched again after the last selectable mode, the exemplary light mode control system cycles back to the first, e.g., default, mode. At the end of the synchronize time, the system goes into the mode selected. If the power is switched off and on in under five seconds once the synchronize time is over and the system has switched into a particular mode, the system restarts at the beginning of a new synchronize time in the first, e.g., default, mode.

The number of modes is only limited by the possible combinations of static or blinking colors or combinations of colors of LEDs, and each mode may be characterized by different characteristics, such as a constantly changing color pallet, a changing color pallet that remembers the final color selected and stays there, or a pallet that moves between two selected colors, for example.

If a mode is selected that is characterized by a static color, that color will be displayed each time the system is turned on, as long as the interval between powering off and back on is more than the switching time that for the present embodiment is five seconds. If the system is turned off and on in less than the switching time, it reverts to the first default mode and a new synchronize time starts. If a color-changing mode is selected, once the synchronize time ends, the system goes into that mode's color-changing cycle.

An exemplary color-changing device may cycle through all or a range of the LED array's possible colors in a predetermined time. In one embodiment, it may take 60 seconds to cycle through all of the colors of an array or system. The range of possible colors in a particular cycle depends on the characteristics of the mode. For instance, one color-changing mode may cycle through all possible colors. A second color-changing mode may be limited to colors between orange and purple, for example. The number of modes is limited only by the number of combinations of colors, and blinking rates possible in the LED array. So, while not infinite, a very large number of modes are possible in any given system.

Color-changing modes may be either continuous or selectable. A continuous color-changing mode constantly cycles through its range of colors. When the system is powered off for a period greater than the switching time, which again is five seconds in the present embodiment, once the system is powered on again, the color display of the LED array continues to cycle starting from any predetermined position, including the last color displayed before the power was turned off. By contrast, a selectable color cycle cycles through a range of colors just like a continuous cycle. However, when a selectable cycle is powered off for a period greater than the switching time, it retains the last displayed color as a static color once it is powered on again, and retains that color until the system is reset by powering off and on in a period less than the switching time.

FIG. 1 shows a basic block diagram of the presented work, the user interface 1 gets the ON/OFF input and sends it to the microcontroller 3 which drives the LED Drivers 5. The driver circuit drives single or combination of red, blue and green lighting devices or LEDs 7, which are used as the light source, and according to the inputs and microcontrollers signals, the LED's emit light.

Figure 2:
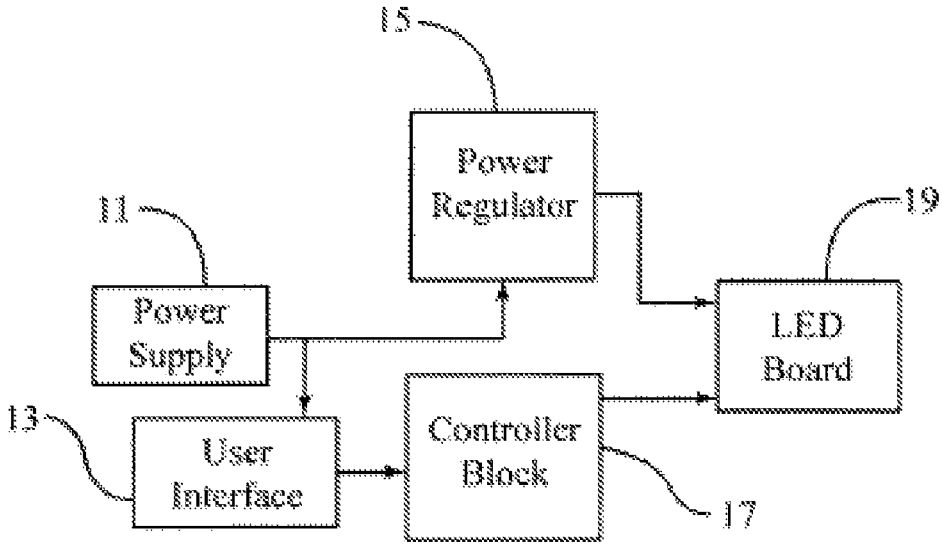
FIG. 2 shows a top level block diagram of an exemplary circuit of the present invention.

FIG. 2 shows a top-level block diagram of the device circuit which includes a power supply 11, a user interface 13, a power regulator block 15, a controller block 17 and LED board 19. When the power supply 11 is itself powered and there is an input at the user interface 13, the controller block 17 sends control signals to the LED board 19 according to the mode/function selected via the input. The LED board 19 receives the regulated power from the power regulator block 15 for the LED output associated with the mode/function selected.

Figure 3A:
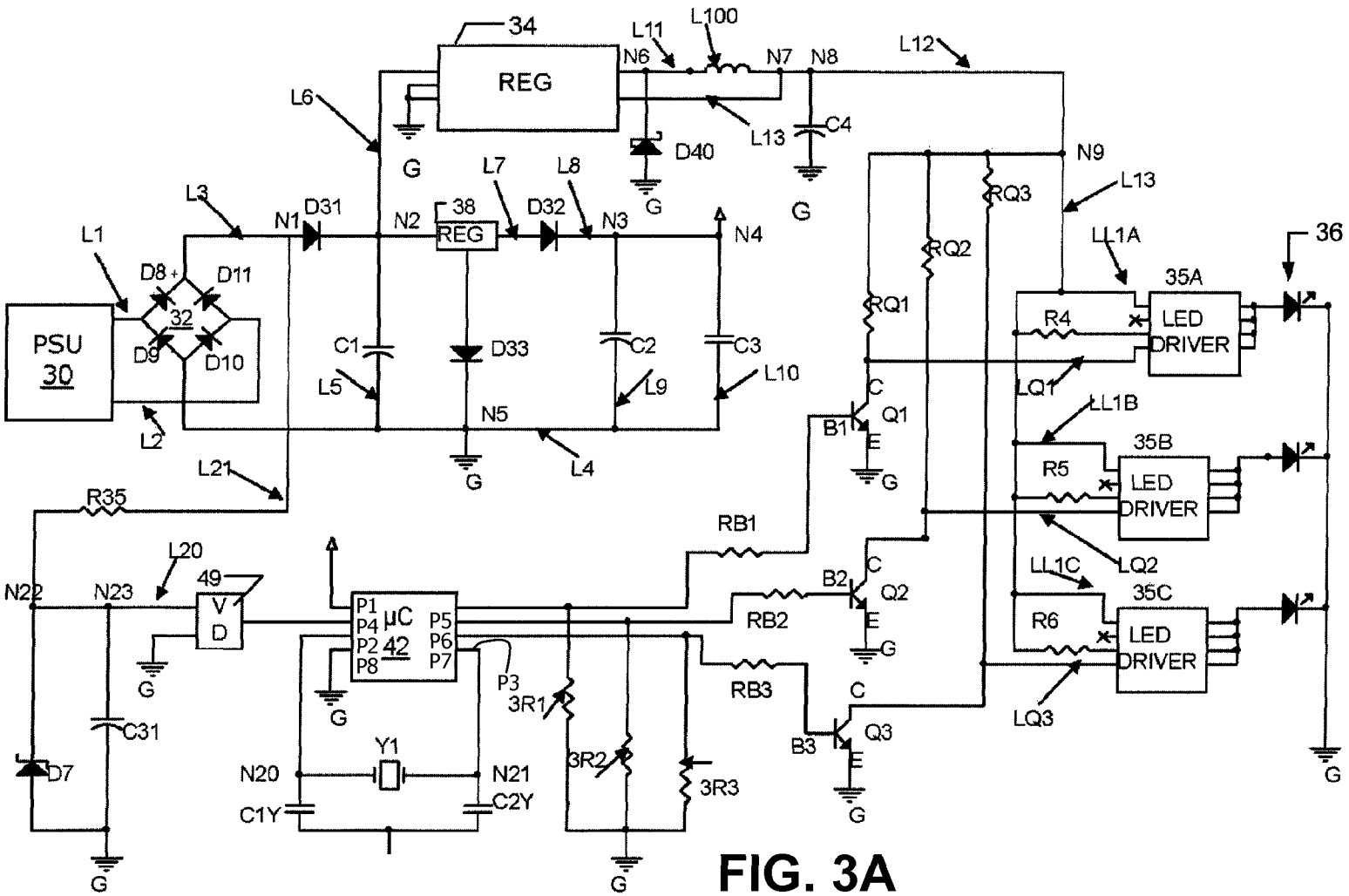
FIG. 3A shows circuit diagram of an exemplary color-changing system embodiment of the present invention.

FIG. 3A shows a circuit diagram of an embodiment of the present invention which is designed to operate on low voltage. The device includes a power supply unit (PSU) 30 with a two-point connector that receives the 12V AC input from the step down transformer (not shown in the figure). The bridge assembly 32 comprises rectifier diodes D8, D9, D10, D11 which convert the AC into a pulsating DC signal. The converted signal is then fed to the power regulator section which regulates the voltage to 5 V LED driver circuit. Although a 5 V LED driver circuit is contemplated in this example, the present invention also contemplates a range of line voltages from any regulated or unregulated power supply. Applications of embodiments of the present invention may be in systems generating DC low voltage power and accordingly may be powered by hybrid and/or renewable energy sources such as wind and/or solar-derived energy sources.

Figure 3B:
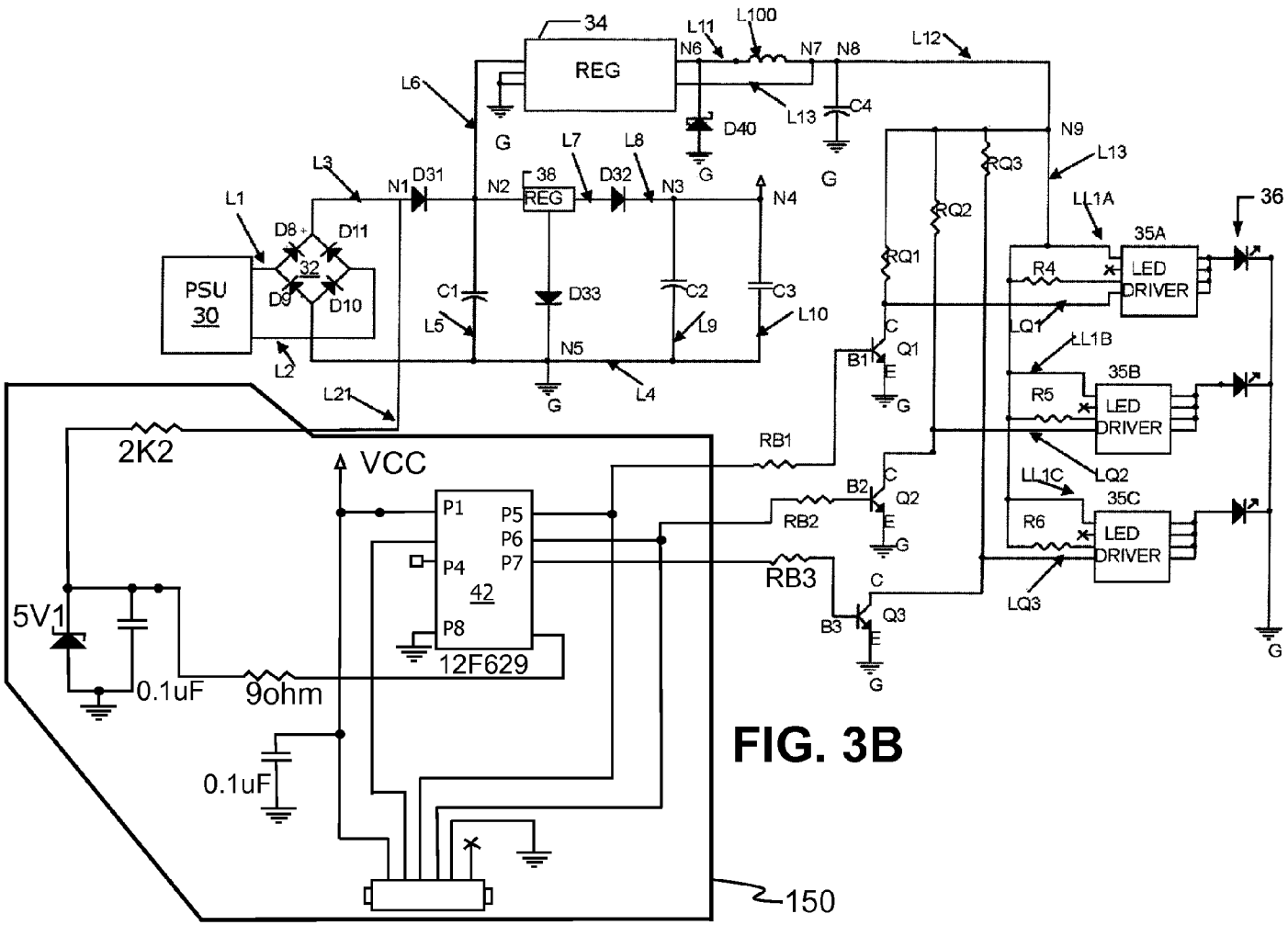
FIG. 3B shows circuit diagram of an exemplary color-changing system embodiment of the present invention.

According to the example of FIG. 3B, the filter capacitors C1, C2, C3, C4 and linear 5V regulators (REGs) 38 and 42 (LM 7805 and LM 2576 in the present example) are used for high current application. The pulsating DC signal is applied to the user interface which senses the switch ON/OFF time period and changes the state of the light accordingly. The Zener diode D7 keeps the input signal to the voltage detector (VD) 49, MCP100, at fixed level when power is on at 5.1V. The output of the MCP100 changes to "low" as soon as the power is off, and provides active low switch input for the microcontroller (μC) 42. The user interface provides input to the micro-controller (μC) 42, PIC 12F629 having pin numbers P1, P2, P3, P4, P5, P6, P7, and P8. The microcontroller (μC) 42 communicates with the user using pin number 4 to detect a power fail. The microcontroller (μC) 42 runs at 8 bits so that 256 possible voltage levels for can be achived. Thus, 256 current values and equivalent levels of intensity per LED are achived. An external crystal Y1 provided with the microcontroller (μC) 42 synchronizes all light modules. The digital signal from pins 5, 6, 7 control the intensity of R, G, B LEDs (LED diodes) 36 respectively by turning on and off LED drivers 35A, 35B and 35C, on chips, using transistors Q1, Q2 and Q3. An external resistor allows the circuit designer to set the drive current for different LED arrays. It also supplies constant current for varying input voltage. External resistors R4, R5, R6 allow current to be set, upto 350 mA of each leg of distinct color LEDs (LED diodes). The control card which uses ICs (for LED drivers 35A, 35B and 35C) numbered NUD 4001 which connects with the LED board where the color-changing LED diodes 36 or combination of LEDs (LED diodes) are connected.

In FIG. 3A, the PSU 30 includes line L1 connected to a bridge rectifier 32 between an anode of diode D8 and a cathode of diode D9 and a second line L2 connected between a cathode of diode D10 and anode of diode D11. Line L3 is coupled between cathodes of diodes D8 and D11 to an anode of diode D31. The anode of diode D31 is coupled to node N1 in line L3. The cathode of diode D31 is coupled to REG 38. Node N2 is placed between REG 38 and the cathode of diode D31. Line L4 is coupled to bridge rectifier 32 between anodes of diodes D9 and D10. Line L4 includes a node N5, where node N5 is connected to ground G. Node N5 is hereinafter referred to as a "ground node N5."

FIG. 3A shows that line L5 extends between node N2 and line L4. An anode of capacitor C1 is connected to node N2 and a cathode of capacitor C1 is connected to line L4 and, hence, ground node N5. Line L6 connects to and extends between REG 34 and node N2. Line L7 is coupled to an anode of diode D32 and REG 38. A cathode of diode D32 is coupled to node N3 in line L8. Line L9 extends between node N3 and line L4. An anode of capacitor C2 is coupled to node N3. A cathode of capacitor C2 is connected line L4 and, hence to ground node N5. Line L8 extends between the cathode of diode D32 and node N4. Line L10 extends between node N4 and line L4. Line L10 includes capacitor C3 having one side connected to line L4 and, hence, ground node N5. The other side of capacitor C3 is connected to node N4. REG 38 is also coupled to an anode of diode D33. The cathode of diode D33 is coupled to line L4 at ground node N5 in line L4.

FIG. 3A also illustrates that at voltage regulator REG 34, two additional leads or lines on an input side of REG 34 are shown coupled to ground G. Lines L11 and L13 are shown as extending from an output side of REG 34. Line L11 includes inductor L100. Between REG 34 and one side of inductor L100 is node N6. A cathode of a Schottky diode D40 is coupled to node N6, where node N6 is between REG 34 and inductor L100. The anode of Schottky diode D40 is coupled to ground G. Line L13 extends from REG 34 to the other side of the inductor L100 at node N7. Line L12 has node NS. Node NS has an anode of capacitor C4 coupled thereto. The cathode of capacitor C4 is coupled to ground G.

FIG. 3A illustrates that line L12 also includes node N9. Node N9 has the collectors C of transistors Q1, Q2 and Q3 coupled thereto through resistors RQ1, RQ2, RQ3, respectively, in the collector paths of transistors Q1, Q2 and 43. The emitters E of transistors Q1, Q2 and Q3 are coupled to ground G. The collectors C of transistors Q1, 42 and Q3 are also coupled to a respective different one LED Driver 35A, 35B and 35C via lines LQ1, LQ2 and LQ3 where LQ1, LQ2 and LQ3 are coupled to one side of the resistors RQ1, RQ2, RQ3, respectively. The other side of each of the resistors RQ1, RQ2, RQ3 is coupled node N9. From node N9 extends line L13. From line L13 extends line LL1A to the LED Driver 35A; line LL1B to LED Driver 35B; and line LL1C to LED Driver 35C. From Line L13 extends a line to the LED Driver 35A having resistor R4; a line to LED Driver 35B having resistor R5; and a line to LED Driver 35C having resistor R6. The circuit is configured to accommodate digital and analog dimming.

FIG. 3A illustrates that the other side of each of LED Driver 35A, LED Driver 35B, and LED Driver 35C is coupled to a respective different one of the LED diodes 36, where the LED diodes 36 are coupled to ground G. Returning again to the bases of transistors Q1, 42 and Q3, base B1 of transistor Q1 has one side of resistor RBI coupled thereto; base B2 of transistor Q2 has one side of resistor RB2 coupled thereto; and base B3 of transistor 43 has one side of resistor RB3 coupled thereto. The other side of each resistor RB1, RB2, RB3 is coupled to a respective different one of first, second and third outputs of microcontroller 42. A plurality of resistors 3R1, 3R2 and 3R3 all have one side thereof coupled to ground G. The other side of resistor 3R1 is coupled to said other side of resistor RBI between resistor RBI and the first output of micro-controller 42. The other side of resistor 3R2 is coupled to said other side of resistor RB2 between resistor RB2 and the second output of microcontroller 42. The other side of resistor 3R3 is coupled to said other side of resistor RE33 between resistor RB3 and the third output of microcontroller 42. The microcontroller 42 is coupled to ground G. The microcontroller 42 is coupled to one side of crystal Y1 at node N20 and the other side of crystal Y1 at node N21. Nodes N20 and N21 are connected to micro-controller 42. One side of capacitor C1Y is coupled to one side of capacitor C2Y. The other side of capacitor C1Y is coupled to node N20. The other side of capacitor C2Y is coupled to node N21. The voltage detector (VD) 49 has an input side and an output side. The output side of VD 49 has a lead coupled to the microcontroller 42. The VD 49 is coupled to ground G. Additionally, another line L20 from the input side of VD 49 is coupled to a cathode of Zener diode D7 at node N22. The anode of Zener diode D7 is coupled to ground G. Between node N22 and VD 49 is node N23. Capacitor C31 has one end coupled to ground G and the other end coupled to node N23. Line L21 extends from node N22 to node N1 in line L3. In the path of line L21 is resistor R35. The controller uses an external or internal crystal for DC power to allows all light modules in the system to be synchronized, and is capable of storing the mode and color, or combination of colors, at the time it is switched off. In an alternate embodiment shown in FIG. 3B, AC power can also be used for synchronization by detecting zero crossing point as shown in FIG. 3B where the circuit modification over FIG. 3A is shown in the boxed region 150.

Figure 4:
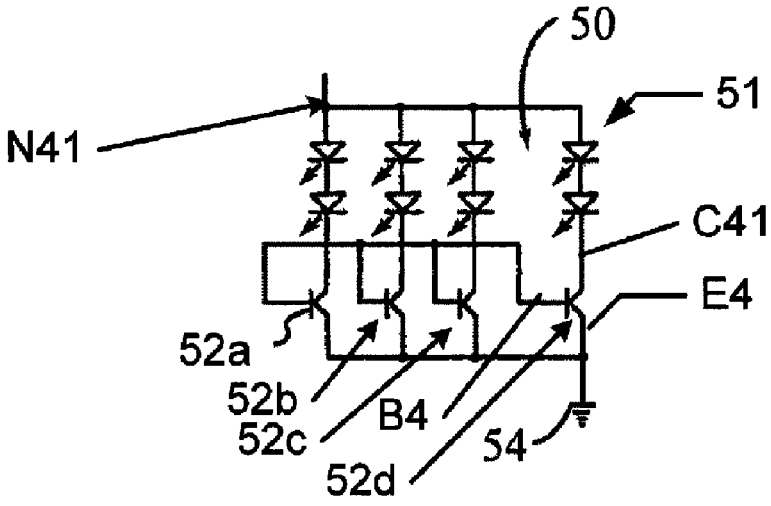
FIG. 4 shows an exemplary electrical circuit for an LED board.

FIG. 4 shows the electrical circuit of the LED boards used in the present embodiment. In the circuit diagram, one LED each of red, blue and green or an array 50 of green, blue and red LEDs are used as the light source. This LED board design is such that despite variations in forward voltage from different LEDs, the current remains equal in each LED or LED array 50 with the help of the transistors 52*a*, 52*b*, 52*c* and 52*d* in the LED board 19.

FIG. 4 illustrates an array 50 with four transistors 52*a*, 52*b*, 52*c* and 52*d*. The base B4 of each transistor 52*a*, 52*b*, 52*c* and 52*d* is coupled to each other. The emitter E4 of each transistor 52*a*, 52*b*, 52*c* and 52*d* is coupled to ground 54. Each collector C41 has coupled thereto a different pair of series coupled LED diodes 51. Node 41 receives an input to LED diodes 51.

Figure 5:
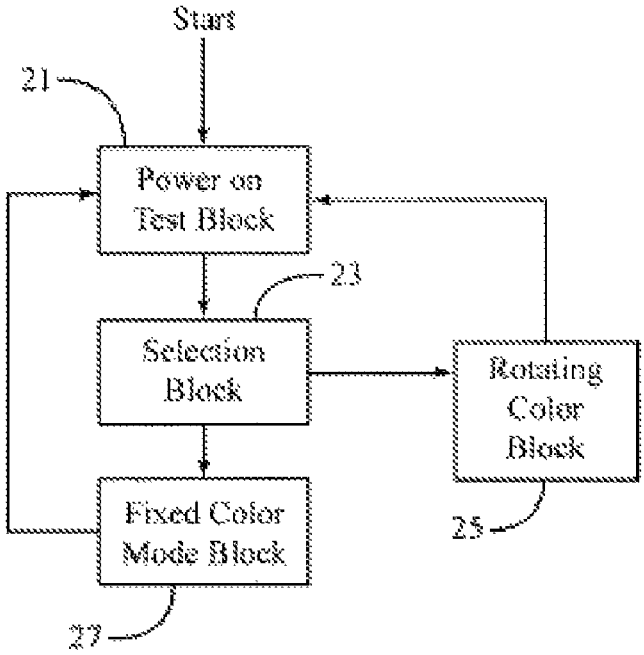
FIG. 5 shows a top-level block diagram of the flow of the program in the presented system.

FIG. 5 shows a top-level block diagram of the flow of the program in the presented system. Power on test is performed at Block 21. At Block 21, when the power is on for the first time, the first (default) mode LED will blink or flash, and the system goes into synchronize time. At Block 23, during synchronize time a user has the option of switching modes. The selection block 23 checks for the user's selection of the mode for running on the system for a fixed time and accordingly switches to the respective block rotating color mode 25 or block fixed color mode 27. These respective blocks, i.e., block 25 or block 27, run the mode until the user interface supplies some other input to return to a subsequent instance of synchronize time. When system is switched off after use, the mode of operation and color or color combinations are stored and the settings are restored until the next restart.

Figure 6A:
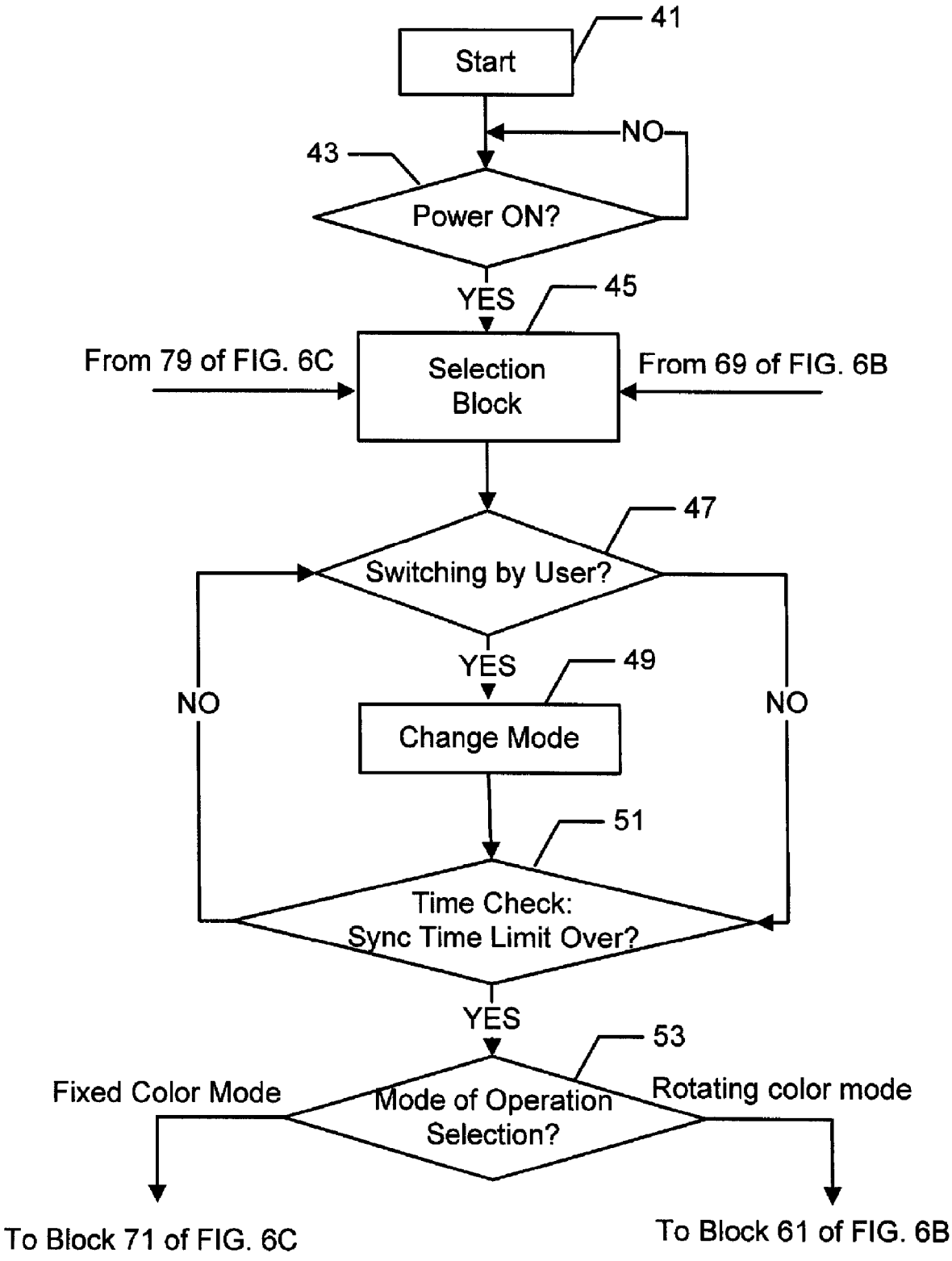
FIGS. 6A-6C is a flowchart of an exemplary method of the present invention; program work.
Figures 6B, 6C:
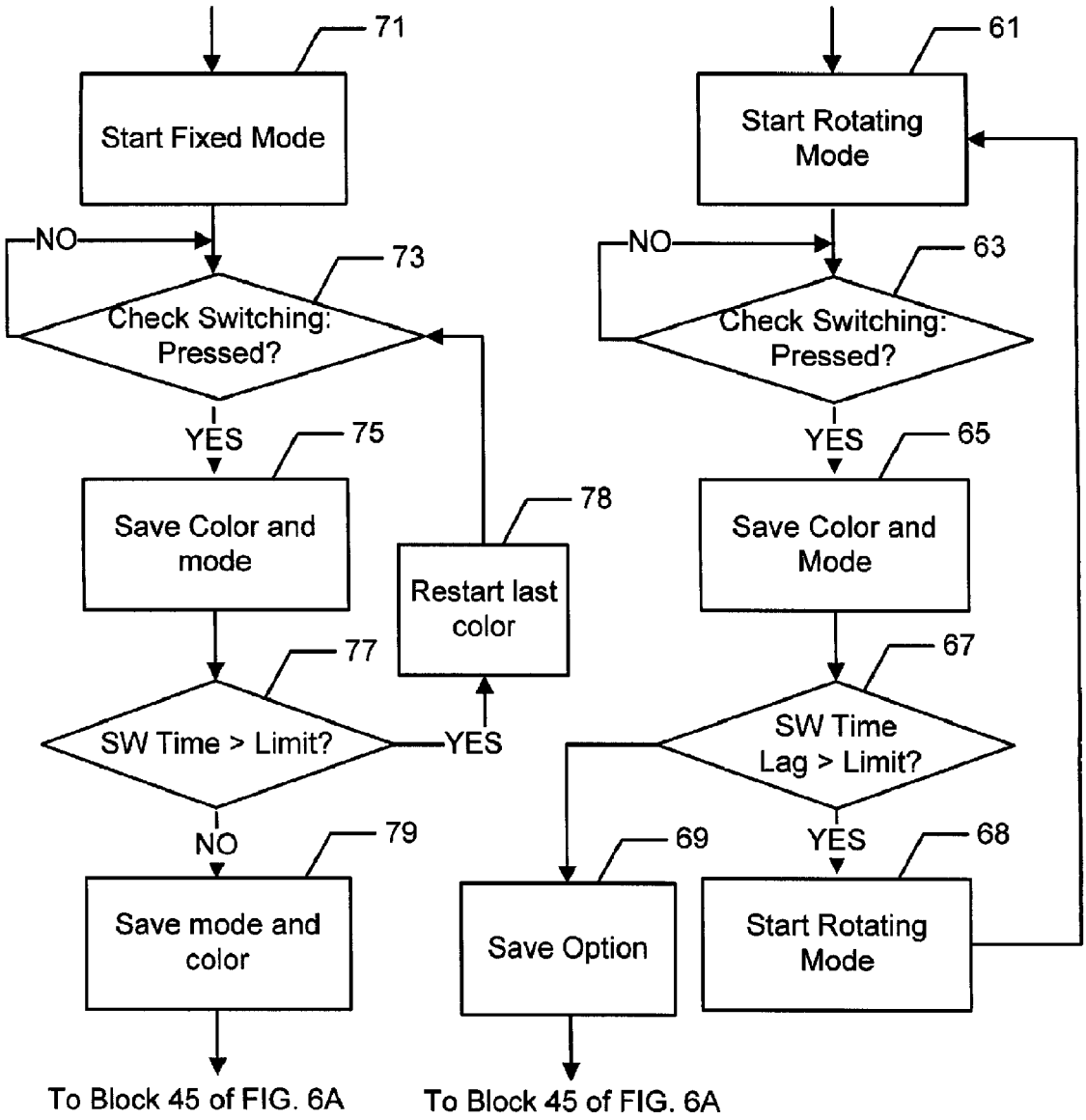

FIGS. 6A-6C show a flowchart of an exemplary process of operation of the exemplary system. The system starts at block 41, followed by power on test at block 43 and a selection block 45 if system is powered on, these steps of operation are named as "synchronize time" or "switching option mode" with a predetermined cycle time. Here, block 47 checks for switching operation by the user. If switching is done, the mode is changed as depicted by the block 49, and a time check is performed in block 51. If the predetermined synchronize time limit is not over, the control goes to the block 47 again otherwise a check is performed for mode of operation selection in block 53.

If the mode is set to rotating color, the operation starts with the block 61 (FIG. 6B) and the indicator LED for the mode starts blinking, depicting the rotating color mode of operation. Block 63 checks for the switching operation and, if the switch is pressed to initiate a submode, control goes to block 65 where the program stores the last color and mode of operation of the system, and in the next control block 67, checks for the time lag of the switching. In the present example, if switching is more than five seconds, the system starts at block 68 with the last mode selected and starts at a predetermined position from block 61, otherwise the control goes back to block 45 via block 69 where a save option takes place.

If the mode of operation selected is fixed color mode, the indicator LED for that mode starts indicating the fixed color mode of operation. In this mode, the system starts with a rotating color cycle at block 71 (FIG. 6C), which allows the user to select from the available choices as an exemplary submode. Block 73 checks for the switching operation. If the switch is pressed, control goes to the next block 75 where the system saves the last color and mode of operation. A check is performed in block 77 to determine if the time between pressing the switch is more than 5 seconds, if it is, the system reinstates the last color position at block 78 and control goes back to block 73. If it is not, control goes to block 79 where the system saves the color and mode of operation and control goes to block 45.

Figure 6D:
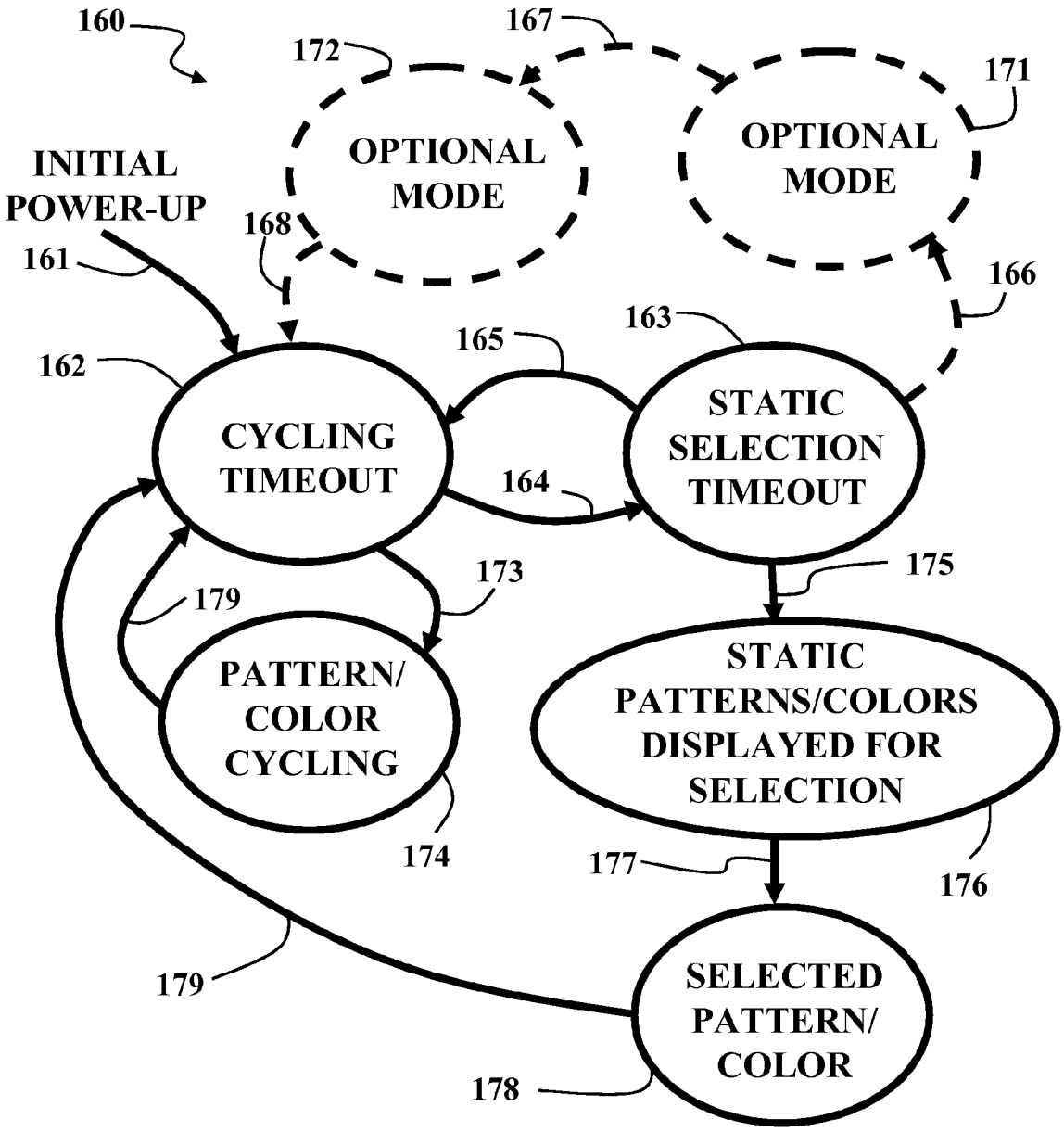
FIG. 6D shows a state diagram of operation of an exemplary embodiment of the present invention.

FIG. 6D shows a state diagram of operation 160 of an exemplary embodiment of the present invention. Upon initial power-up 161, the device may go into an initial, or default, mode of operation, e.g., a timeout counter for a continuously cycling through a plurality of light patterns and/or colors of the light array 162. Within the first time interval, the mode may be switched to another mode, e.g., a timeout counter for a mode providing for selection of a static, fixed, or otherwise non-cycling, light pattern and/or color of the light array 163. The transition, or switch, to another mode may be effected by a power off-on cycle 164 within the first predetermined time interval and additional switching 165 may be effected within the first predetermined time interval to additional optional modes 171, 172, and the one or more additional transitions, or switches 165-168, may return the device to the initial mode of operation 162, directly, e.g., transition/switch 165, or, if additional optional modes 171, 172 are present, via successive transitions/switches 166-168. The timeout counter for a continuously cycling through a plurality of light patterns and/or colors of the light array 162, upon counting out the first time interval, may effect a transition 173 to a mode of cycling a plurality of light patterns and/or colors 174. The selected mode of cycling a plurality of light patterns and/or colors 174 may be saved or otherwise preserved, e.g., via a power off-on cycle of at least the second predetermined time interval, as a submode (not shown) so that after a long-term power off and then power on, the device starts in the previously selected submode of cycling a plurality of light patterns and/or colors 174. The timeout counter for a mode providing for selection of a static, fixed, or otherwise non-cycling, light pattern and/or color of the light array 163, upon counting out the first time interval, may effect a transition 175 to a mode providing for selection of a static, fixed, or otherwise non-cycling, light pattern and/or color of the light array 176. Selection of a displayed light pattern and/or color may be effected by a power off-on cycle 177 of at least the second predetermined time interval. The device may then transition into a submode of displaying the selected pattern and/or color 178. The selected pattern and/or color 178 may be saved or otherwise preserved so that after a long term power off and then power on, the device starts in the submode of displaying the previously selected pattern and/or color 178. The device may be reset 179 from the submode of displaying the selected pattern and/or color 178, and/or from the mode or submode of cycling a plurality of light patterns and/or colors 174, via a power off-in cycle of less than the third predetermined time interval. Embodiments of the device may be reset from other modes and submodes according to the configuration of the device.

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further it is intended that the scope of the present invention herein disclosed by way of examples should not be limited by the particular disclosed embodiments described above.

What is claimed is:

1. A device comprising:

a color-changing light array powered by a driver circuit, the driver circuit responsive to a controller circuit and the controller circuit responsive to a user interface, wherein the controller circuit is configured to:

start with an initial mode of operation upon the powering on of the color-changing light array;

provide a visual display of a mode of operation via the color-changing light array;

change the initial mode of operation to a selected mode of operation responsive to a power off-on cycle of the color-changing light array within a range of a first predetermined time interval;

determine weather the selected mode of operation produces a continually cycling display from a set of light patterns or colors, and if so, then: preserve the selected mode of operation, and start the continually cycling display from a predetermined light pattern or color; and determine weather the selected mode of operation produces selectable displays of static light patterns or colors, and if so, then: responsive to a color-changing light array power off-on cycle, from the user interface, having at least the range of a second predetermined time interval, preserve the selected mode of operation having the last selectable display of light patterns or colors, displayed at a start of the color-changing light array power off-on cycle of the second predetermined time interval, as a static light pattern or color.

2. The device of claim 1 wherein, the selected mode of operation produces the continually cycling display from the set of light patterns or colors, and wherein the controller circuit is further configured to preserve the selected mode, responsive to a color-changing light array power off-on cycle having at least the range of the second predetermined time interval, and restart the continually cycling display from the predetermined displayed light pattern or color.

3. The device of claim 1 wherein the controller circuit is further configured to reset the modes of operation based on power off-on cycling of the color-changing lighting array within a third predetermined time interval while the controller circuit is in any selected mode of operation; and restart with the initial mode of operation.

4. The device of claim 3 wherein the second predetermined time interval and the third predetermined time interval are equal.

5. A device comprising:

a color-changing light array powered by a driver circuit, the driver circuit responsive to a controller circuit and the controller circuit responsive to a user interface, wherein the controller circuit is configured to:

set an initial mode of color-changing light array operation to a first mode of color-changing light array operation based on a powering of the color-changing light array;

change the first mode of color-changing light array operation to a subsequent mode of color-changing light array operation based on power off-on cycling of the color-changing lighting array, from the user interface, within a first predetermined time interval; and change from one of a plurality of modes of color-changing light array operation to a submode of color-changing light operation, after the expiration of the first predetermined time interval.

6. The device of claim 5 wherein the plurality of modes of color-changing light array operation comprise at least: (a) continually cycling displays from the set of light patterns or colors and (b) selectable displays of static light patterns or colors.

7. The device of claim 6 wherein a submode of the mode of the continually cycling display from the set of light patterns or colors comprises starting the continually cycling display from the predetermined light pattern or color.

8. The device of claim 7 wherein the controller circuit is further configured to reset the mode of color-changing light array operation to the initial mode of color-changing light array operation based on a power off-on cycle within a third predetermined time interval of the color-changing light array.

9. The device of claim 8 wherein the second predetermined time interval and the third predetermined time interval are equal.

10. The device of claim 6 wherein a submode of the mode of the selectable displays of static light patterns or colors comprises a static light pattern or color based on the last selectable display of light patterns or colors, displayed prior to the color-changing light array power off-on cycle of a second predetermined time interval.

11. The device of claim 10 wherein the controller circuit is further configured to reset the mode of color-changing light array operation to the initial mode of color-changing light array operation based on a power off-on cycle within a third predetermined time interval of the color-changing light array.

12. The device of claim 11 wherein the second predetermined time interval and the third predetermined time interval are equal.

* * * * *